US008146835B2

(12) United States Patent
Cox et al.

(10) Patent No.: US 8,146,835 B2
(45) Date of Patent: Apr. 3, 2012

(54) SEALING PLATE FOR RAILWAY RAIL CLIP ANCHORING DEVICE AND SLEEPER MANUFACTURING METHOD

(75) Inventors: Stephen John Cox, Richmond (GB); John Phillip Porrill, Godalming (GB)

(73) Assignee: Pandrol Limited, Addelstone, Surrey (GB)

( * ) Notice: Subject to any disclaimer, the term of this patent is extended or adjusted under 35 U.S.C. 154(b) by 543 days.

(21) Appl. No.: 12/279,816

(22) PCT Filed: Feb. 21, 2007

(86) PCT No.: PCT/GB2007/000611

§ 371 (c)(1), (2), (4) Date: Oct. 10, 2008

(87) PCT Pub. No.: WO2007/096621

PCT Pub. Date: Aug. 30, 2007

(65) Prior Publication Data

US 2009/0045265 A1 Feb. 19, 2009

(30) Foreign Application Priority Data

Feb. 21, 2006 (GB) ..... 0603434.2

(51) Int. Cl.
*E01B 9/38* (2006.01)

(52) U.S. Cl. ..... 238/297

(58) Field of Classification Search ..... 238/287, 238/294–298, 308, 309

See application file for complete search history.

(56) References Cited

U.S. PATENT DOCUMENTS 3,471,118 A 10/1969 Bormann et al.
3,581,990 A * 6/1971 Kirik ..... 238/283
3,876,141 A 4/1975 French (Continued)

FOREIGN PATENT DOCUMENTS

DE 658902 4/1938

(Continued)

OTHER PUBLICATIONS

International Search Report and Written Opinion of The International Searching Authority, corresponding to International application No. PCT/GB07/000606.

(Continued)

*Primary Examiner* — S. Joseph Morano
*Assistant Examiner* — R. J. McCarry, Jr.
(74) *Attorney, Agent, or Firm* — Husch Blackwell LLP

(57) ABSTRACT

A sealing plate for use with a rail clip anchoring device having a head and a stem which extends from the head into a concrete sleeper when the anchoring device is in use, is adapted for extending over the underside of the head when the stem of the device is being set in a concrete sleeper, thereby to prevent ingress of concrete into the head of the device, and for being retained on the surface of the sleeper thereafter. A major face of the plate, which is uppermost when the sleeper is in use, is provided with at least one clip seat portion for receiving part of a rail clip. In a method of manufacturing a concrete sleeper with at least one embedded rail clip anchoring device, the floor of a mold, from which the sleeper is to be formed, is provided with an aperture through which the head of an anchoring device is inserted and before concrete is introduced into the mold the aperture is sealed off around its edges and around the underside of the head of the anchoring device by placing a sealing plate over the aperture on the floor of the mold, the plate overlapping and sealing around the edges of the aperture other than where the anchoring device is located and having a mating interface with the anchoring device such that a seal is formed therewith.

5 Claims, 11 Drawing Sheets

U.S. PATENT DOCUMENTS

| | | | | | |
|---|---|---|---|---|---|
| 4,061,270 | A | | 12/1977 | Wandrisco | |
| 4,239,156 | A | | 12/1980 | Skinner et al. | |
| 4,632,307 | A | * | 12/1986 | Weber | 238/265 |
| 4,907,740 | A | | 3/1990 | Oberweiler et al. | |
| 4,927,078 | A | * | 5/1990 | Vanotti | 238/349 |
| 5,474,233 | A | | 12/1995 | Cailliau | |
| 5,520,330 | A | | 5/1996 | Brown et al. | |
| 5,566,882 | A | | 10/1996 | Brown et al. | |
| 5,735,458 | A | * | 4/1998 | Brown et al. | 238/343 |
| 6,702,192 | B2 | | 3/2004 | Igwemezie | |

FOREIGN PATENT DOCUMENTS

| | | |
|---|---|---|
| DE | 2813819 | 10/1979 |
| DE | 8804426 | 5/1988 |
| DE | 3820243 | 2/1990 |
| EP | 826826 | 3/1998 |
| FR | 2450902 | 10/1980 |
| GB | 2106570 | 4/1983 |
| GB | 2117035 | 10/1983 |
| GB | 2235003 | 2/1991 |
| GB | 2239035 | 6/1991 |
| GB | 2261241 | 5/1993 |
| GB | 2351515 | 1/2001 |
| GB | 2358423 | 7/2001 |
| JP | 2002121701 | 4/2002 |
| WO | WO 93/12294 | 6/1993 |
| WO | WO 93/12295 | 6/1993 |
| WO | WO 93/12296 | 6/1993 |
| WO | WO 03/101693 | 12/2003 |
| WO | WO 2005/106124 | 11/2005 |

OTHER PUBLICATIONS

UK Patent Search Report of the UK Patent Office, corresponding to UK application No. 0603434.2.

EPO Standard Search Report issued on priority UK application No. 0603434.2, dated Sep. 8, 2006.

EPO Standard Search Report issued on priority UK application No. 0603434.2, dated Sep. 12, 2006.

* cited by examiner

SEALING PLATE FOR RAILWAY RAIL CLIP ANCHORING DEVICE AND SLEEPER MANUFACTURING METHOD

The present invention relates to a sealing plate for a railway rail clip anchoring device and a sleeper manufacturing method.

In the documents WO93/12294, WO93/12295 and WO93/12296, the present applicants disclosed a railway rail fastening system in which a rail fastening clip is driven laterally onto the rail and can be held in a clip anchoring device (shoulder) in a "pre-assembly" or "parked" position in which the toe portion of the clip does not bear on the rail. This enables railway sleepers to be preloaded at the factory with clips which are held in the pre-assembly position such that when the sleepers are delivered to site the clips can simply be driven home once the rail is in place. In addition, when maintenance of the rail or sidepost insulators (which lie between the rail and the shoulder) is subsequently required, the clip can be driven off the rail back into the pre-assembly position, or further into an "insulator-change position" in which the clip does not overlie the sidepost insulator, so complete withdrawal of the clip from the shoulder is not necessary. Such clips are sometimes known as "switch-on/switch-off" clips. Such a fastening system has proved to be very successful, but the applicant is desirous of making improvements to some aspects of its manufacture and use.

In a co-pending PCT application the applicants disclose a shoulder in which the clip-engaging features on the lower part of the walls of the shoulder are absent.

Figure 1A:
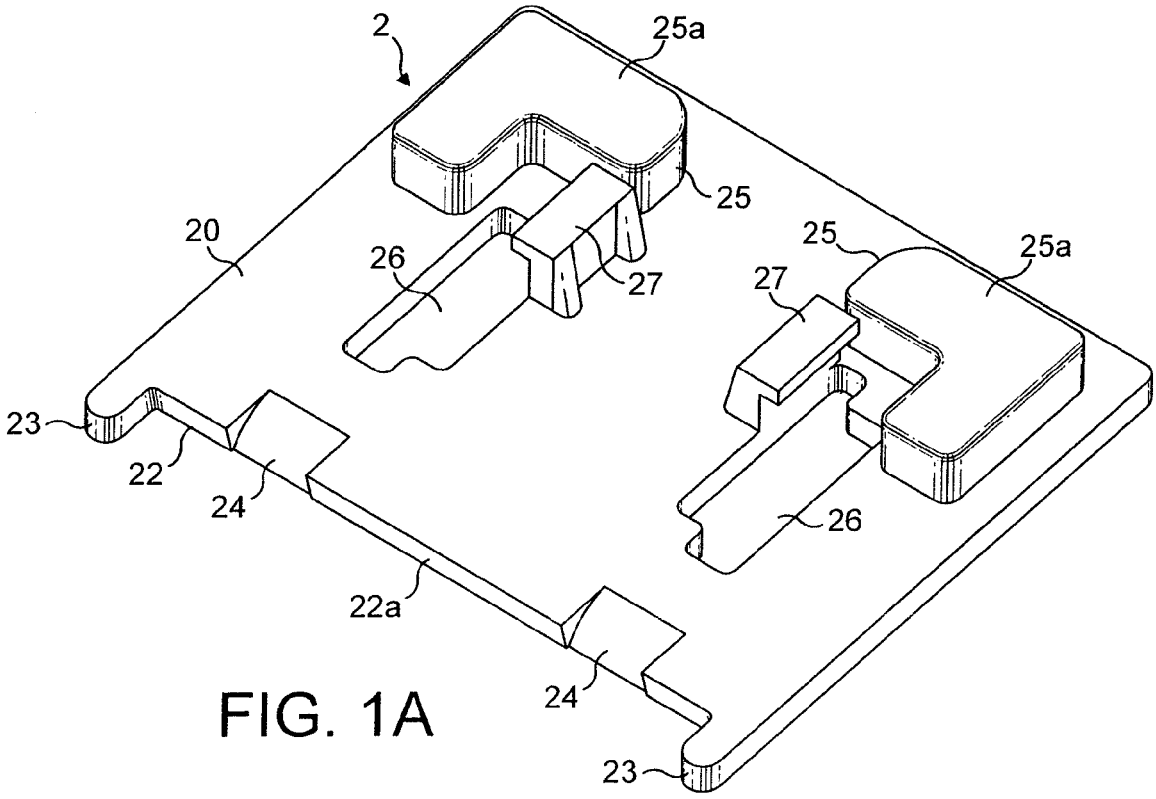
FIG. 1A illustrates the sealing plate from a perspective view from above.

According to a first aspect of the present invention, there is provided a sealing plate, for use with a rail clip anchoring device having a head and a stem which extends from the head into a concrete sleeper when the anchoring device is in use, the plate being designed to extend over the underside of the head when the stem of the device is being set in a concrete sleeper, thereby to prevent ingress of concrete into the head of the device, and to be retained on the surface of the sleeper thereafter, wherein a major face of the plate, which is uppermost when the sleeper is in use, is provided with at least one clip seat portion for receiving part of a rail clip.

Thus the sealing plate can replace the clip engaging features omitted from the shoulder which is the subject of the applicant's co-pending PCT application, and, if made of plastics material, also allows weight and cost, to be taken out of the overall assembly. The plate is desirably made, for example, of nylon, glass-reinforced plastic or similar.

Preferably, the plate is formed such that a seal is created around the periphery of the said major face of the plate when pressure is applied to the other major face, and is desirably made of plastics material.

Preferably, the plate is substantially rectangular in outline.

Desirably, one edge of the plate has a cut-out portion shaped for receiving a portion of the head of the anchoring device adjacent to the stem thereof. The cut-out portion may have a bevelled edge which matches a bevelled edge of the said portion of the head of the anchoring device.

The plate preferably comprises locating means for locating the plate on the head of the anchoring device. The locating means may comprise at least one tab protruding from a major face of the plate for engaging with a corresponding feature on the anchoring device.

The or each clip seat portion may be of greater resilience to wear than other parts of the plate. The clip seat portions (heel seats) of the plate may be reinforced with stronger material or with small steel bearing plates, to cope with the loads on this part of the assembly imparted by the heel portions of the clip.

The clip seat portion may comprise a projection, which is preferably L-shaped in plan.

The clip seat portion may have a clip-receiving surface which is shaped so as to match the profile of that part of the clip which is to bear thereon. By shaping the heel contact areas so that they match the shape of the heel bearing areas of the clip, the pressure on the plastic plate will be reduced.

The major surfaces of the plate may be formed with one or more apertures therethrough for receiving respective a portion of the anchoring device which extends from the underside of the head of the anchoring device.

The major face of the plate which is lowermost when the sleeper is in use is preferably provided with strengthening ribs which intersect to define a plurality of rebates. Thus, the plate is effectively hollowed out underneath, where possible, to reduce section thickness and material. These voids (rebates)

are filled with concrete during sleeper manufacture, which means that the plate is fully supported across its whole lower surface.

When a sealing plate embodying the first aspect of the present invention is used in combination with a concrete sleeper into which it has been set, the major face of the plate which is uppermost when the sleeper is in use may desirably be flush with the uppermost surface of the concrete sleeper.

Typically, shoulders for retaining switch-on/switch-off clips are secured to concrete railway sleepers (ties) by embedding a stem of the shoulder in the concrete during manufacture of the sleeper. The sleepers are manufactured upside down, so that the top of the finished sleeper is formed by the bottom of the mould pocket. During manufacture, the parts of the shoulder that stick up above the finished sleeper therefore stick down through apertures cut into the floor of the mould pockets at appropriate positions for this purpose. The stems of the shoulders that end up cast into the concrete sleeper stick up into the mould pocket before the concrete is poured. The first step in the manufacturing process is to turn the cast shoulder upside down and push it down from above through an aperture in the mould pocket to refusal. When the concrete has been poured and allowed to set, the sleepers are lifted out of the moulds and turned the right way up. A difficulty with the process is that if the apertures in the bottom of the mould pockets are not a very close fit around the edges of the cast shoulders, concrete will leak through the gap and it may then set on to parts of the shoulder above the finished concrete level and prevent the clip from engaging properly. On the other hand, if the aperture is too small, additional dressing off of the shoulder is required, which is very costly. Given that cast iron shoulders are subject to relatively wide tolerances—typically ±0.8 mm or more—and that the patterns used to produce them wear with time and so the physical size of the part reduces with time, it can be difficult to achieve a good compromise between the necessity of sealing and that of ensuring fit. This is especially the case if the shape of the aperture is relatively complex. Flexible rims fitted to the apertures may be a partial solution, but these wear and require maintenance.

According to a second aspect of the present invention, there is provided a method of manufacturing a concrete sleeper with at least one embedded rail clip anchoring device of the type having a head for retaining a rail clip and a stem extending from the underside of the head, in which method the floor of a mould, from which the sleeper is to be formed, is provided with an aperture, the head of an anchoring device is inserted through the aperture such that the head of the device extends out of the mould and the stem of the device is located within the mould, and concrete is introduced into the mould, wherein before the concrete is introduced into the mould the aperture is sealed off around its edges and around the underside of the head of the anchoring device by placing a sealing plate over the aperture on the floor of the mould, the plate overlapping and sealing around the edges of the aperture other than where the anchoring device is located and having a mating interface with the anchoring device such that a seal is formed therewith.

Thus, the sealing plate may be used to seal the aperture in the mould pocket and prevent the ingress of concrete into the head of the shoulder. When in use the sealing plate is effectively glued on to the top of the concrete sleeper, such that its top face is flush with the face of the top surface of the concrete on the sleeper top.

Preferably, before the sealing plate is introduced into the mould, it is connected to the anchoring device so as to extend over the underside of the head, the sealing plate being introduced into the mould together with the anchoring device and located over the aperture when the head is inserted through the aperture. Thus, if designed to interlock with the shoulder, the sealing plate can be accurately positioned with ease, and it cannot move up, forward or side-to-side. Nor can it move down or back because it is bonded to the concrete sleeper.

It can easily be made so as to have a simple outline, which need not match the outline of the shoulder, such as rectangular, so the aperture can also have a simple outline. If formed as a plastic moulding, the sealing plate can also have a much tighter tolerance than a cast-iron part, typically ±0.15 mm. However, if the sealing plate is made so as to be significantly larger than the aperture, neither the exact size nor exact shape of the aperture is critical any longer.

When the aperture in the mould is substantially rectangular and a first face of the head of the anchoring device abuts one side of the aperture, the sealing plate is preferably shaped so as to mate with a second face of the head of the anchoring device, opposite to said first face, and to overlap the edges of the aperture on the other three sides thereof. The edge of the sealing plate which mates with the second face of the head may be bevelled so as to match bevelling on the said second face. The sealing plate is preferably a plate embodying the first aspect of the present invention.

Figure 1B:
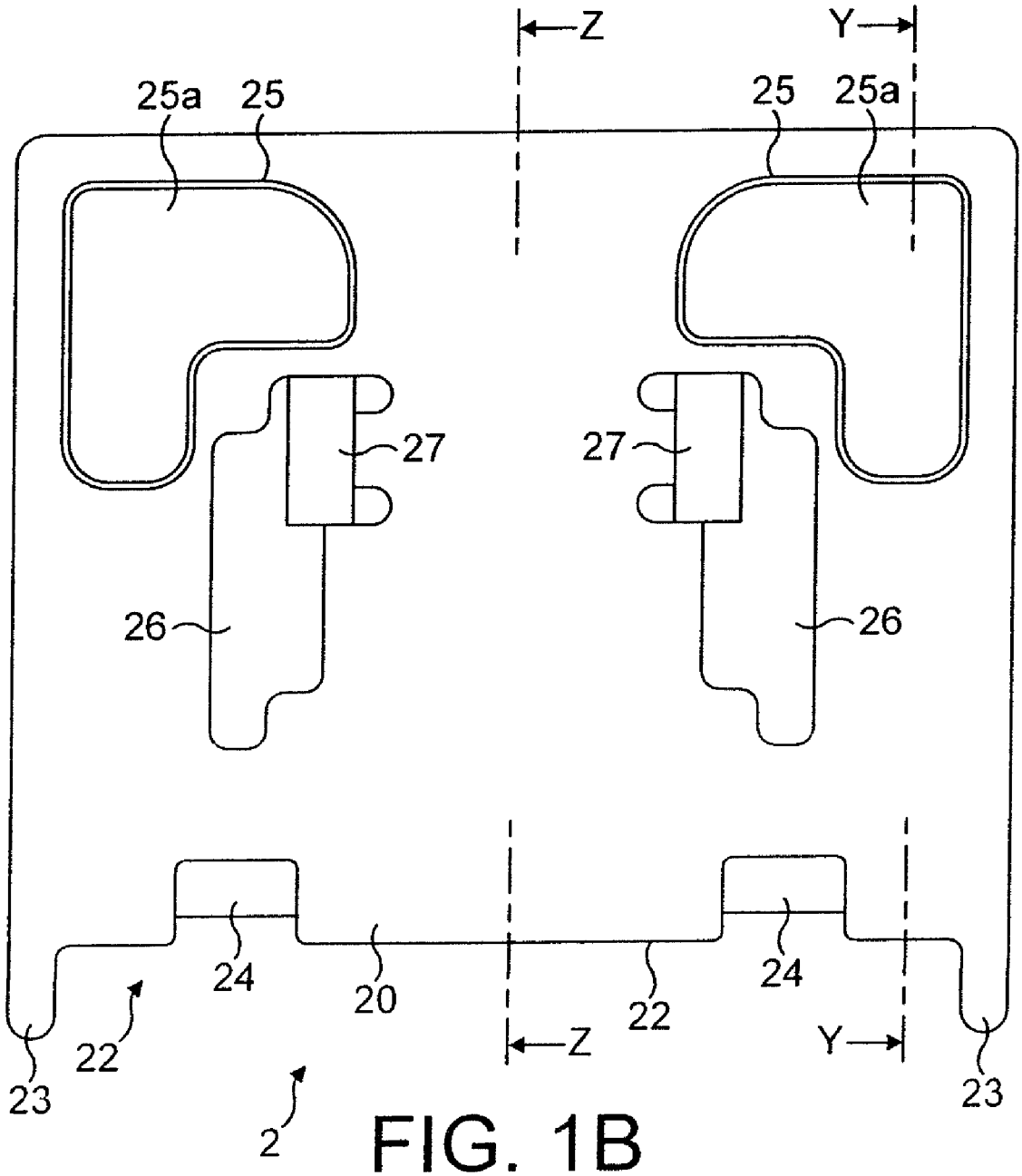
FIG. 1B illustrates a plan view of the top surface of the sealing plate.
Figure 1C:
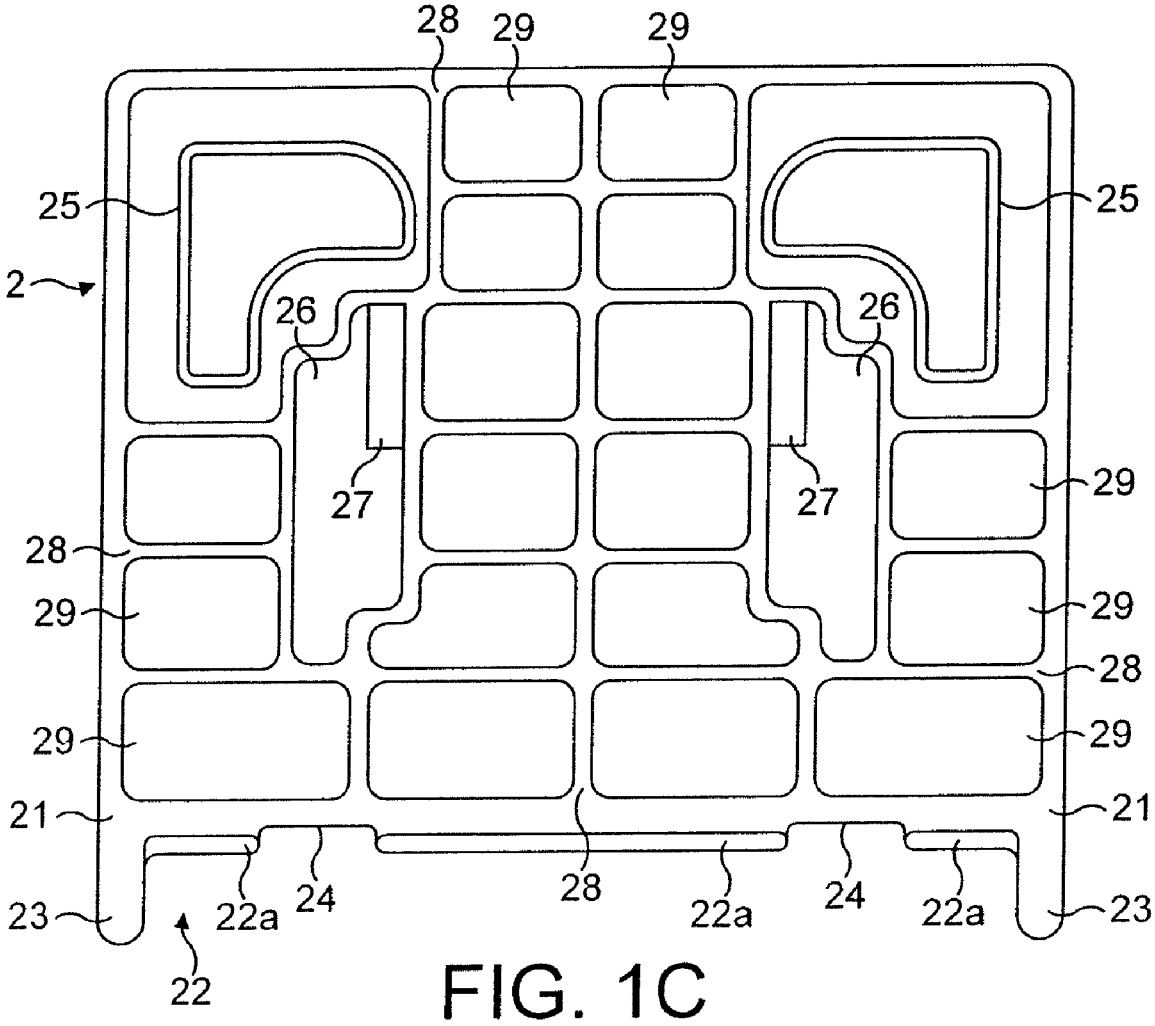
FIG. 1C illustrates a plan view of the underside of the sealing plate.
Figure 1D:
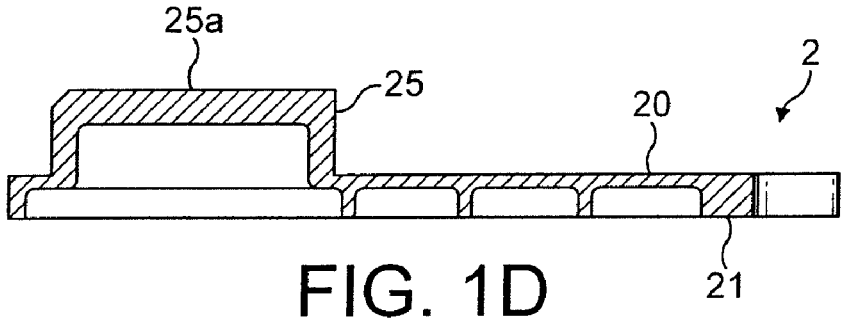
FIG. 1D illustrates a sectional view taken along the line Y-Y in FIG. 1B.
Figure 1E:
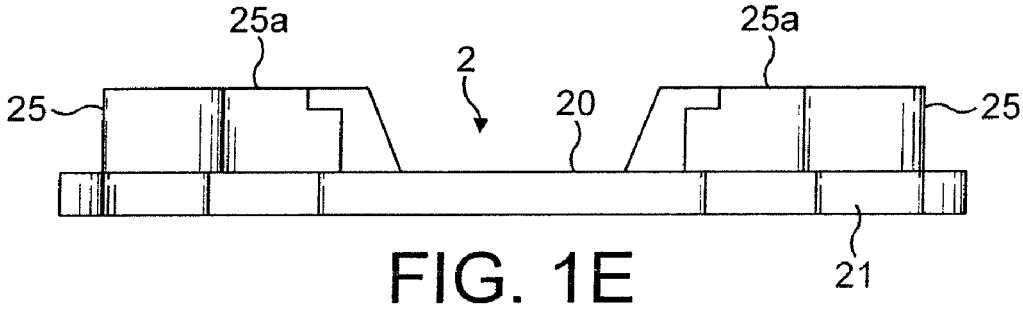
FIG. 1E illustrates a front view of the sealing plate.
Figure 1F:
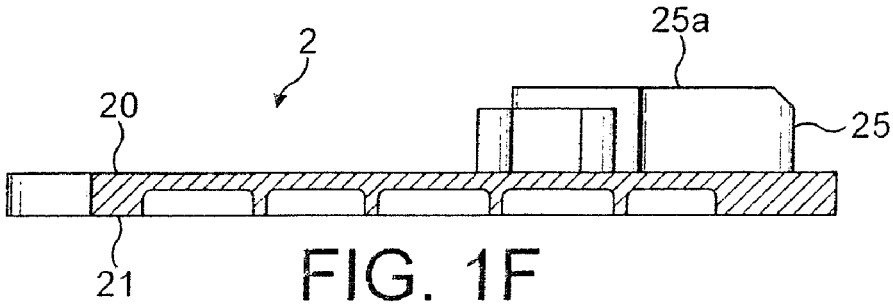
FIG. 1F shows a cross-sectional view of the sealing plate taken along the line Z-Z in FIG. 1B.
Figure 2A:
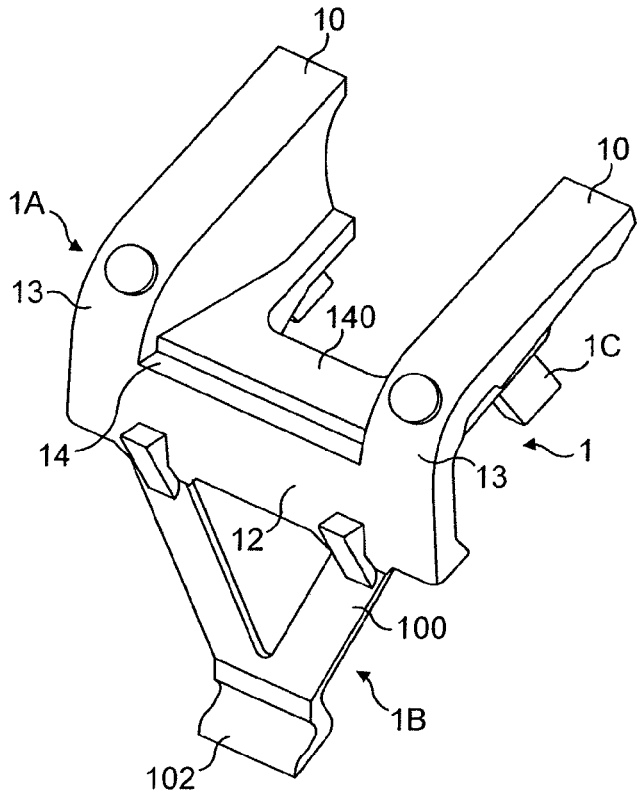
FIG. 2A illustrates a perspective view of the anchoring device suitable for use with a sealing plate.
Figure 2B:
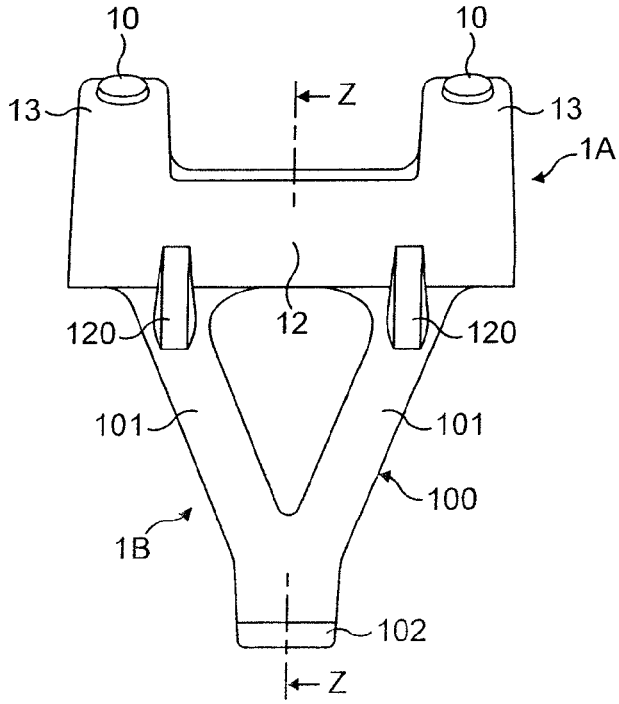
FIG. 2B illustrates a front view of the anchoring device suitable for use with a sealing plate.
Figure 2C:
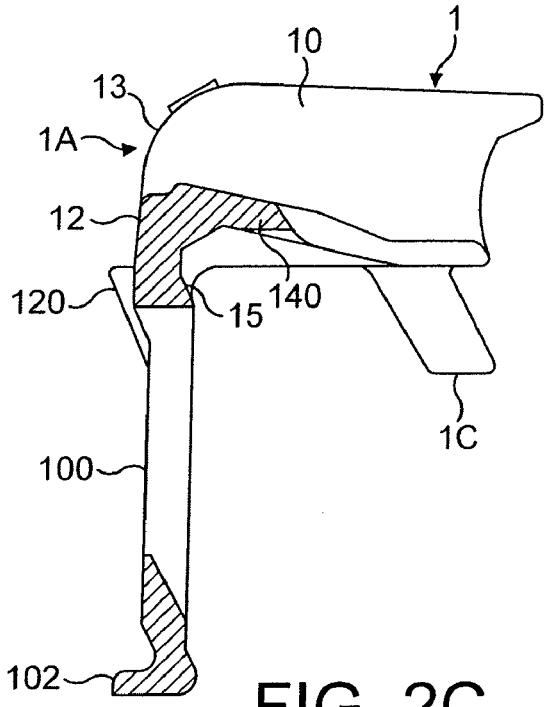
FIG. 2C illustrates a part sectional view of the anchoring device suitable for use with a sealing plate taken along the line Z-Z in FIG. 2B.
Figure 2D:
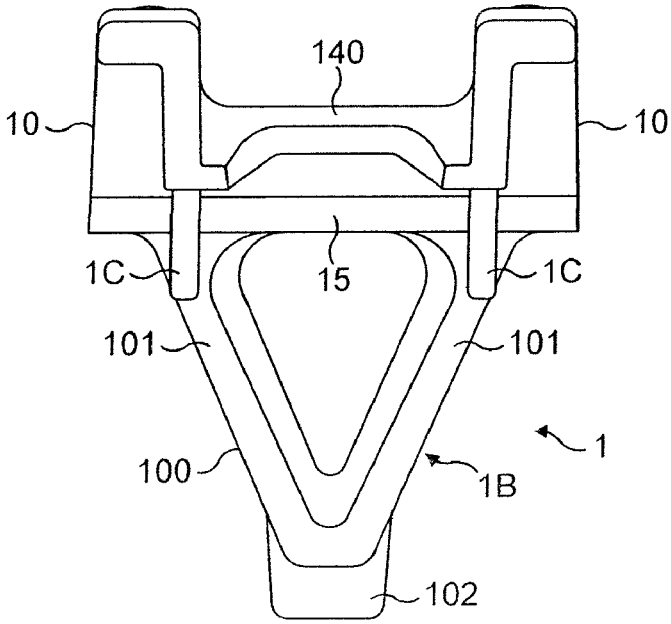
FIG. 2D illustrates a rear view of the anchoring device suitable for use with a sealing plate.
Figure 2E:
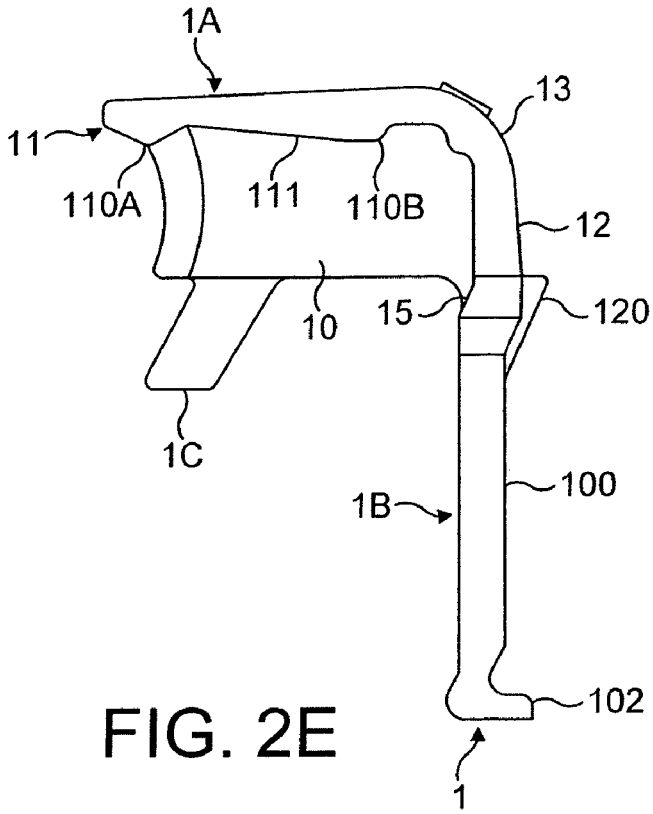
FIG. 2E illustrates a side view of the anchoring device suitable for use with a sealing plate.
Figure 2F:
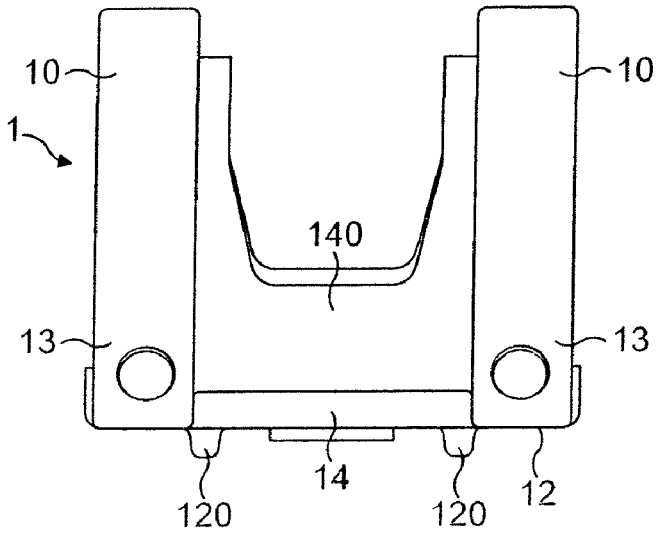
FIG. 2F illustrates a plan view from above the anchoring device suitable for use with a sealing plate.
Figure 2G:
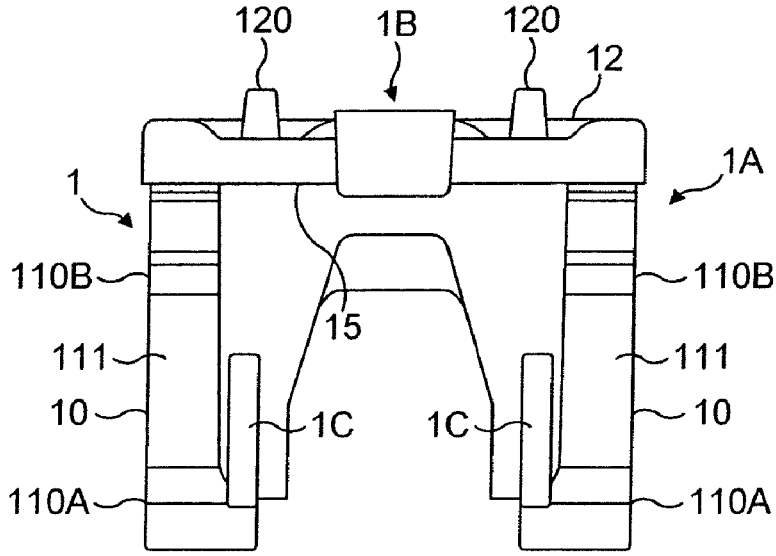
FIG. 2G illustrates a plan view from below the anchoring device suitable for use with a sealing plate.
Figure 2H:
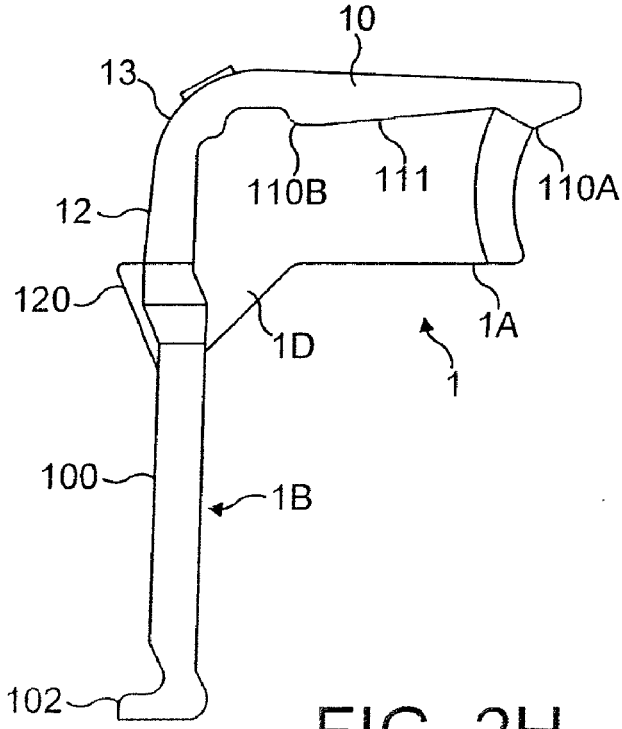
FIG. 2H illustrates a side view of another anchoring device suitable for use with a sealing plate.
Figure 3A:
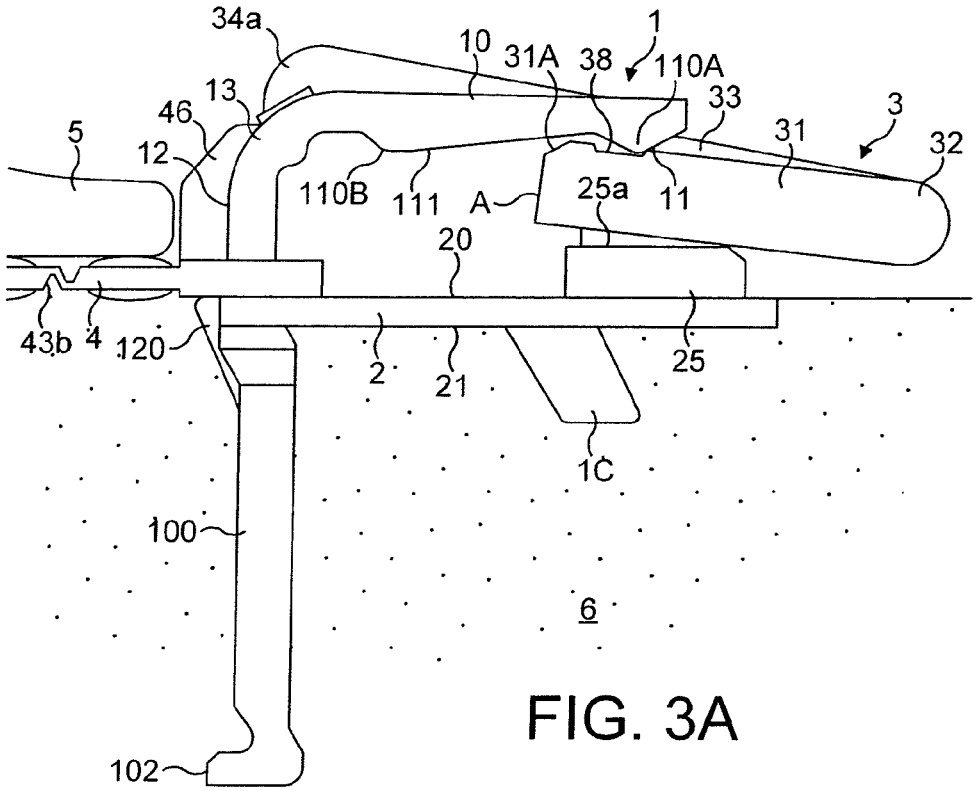
FIG. 3A illustrates a railway rail fastening assembly employing a sealing plate in a side view in which a rail fastening clip is in a pre-assembly position with respect to the rail.
Figure 3B:
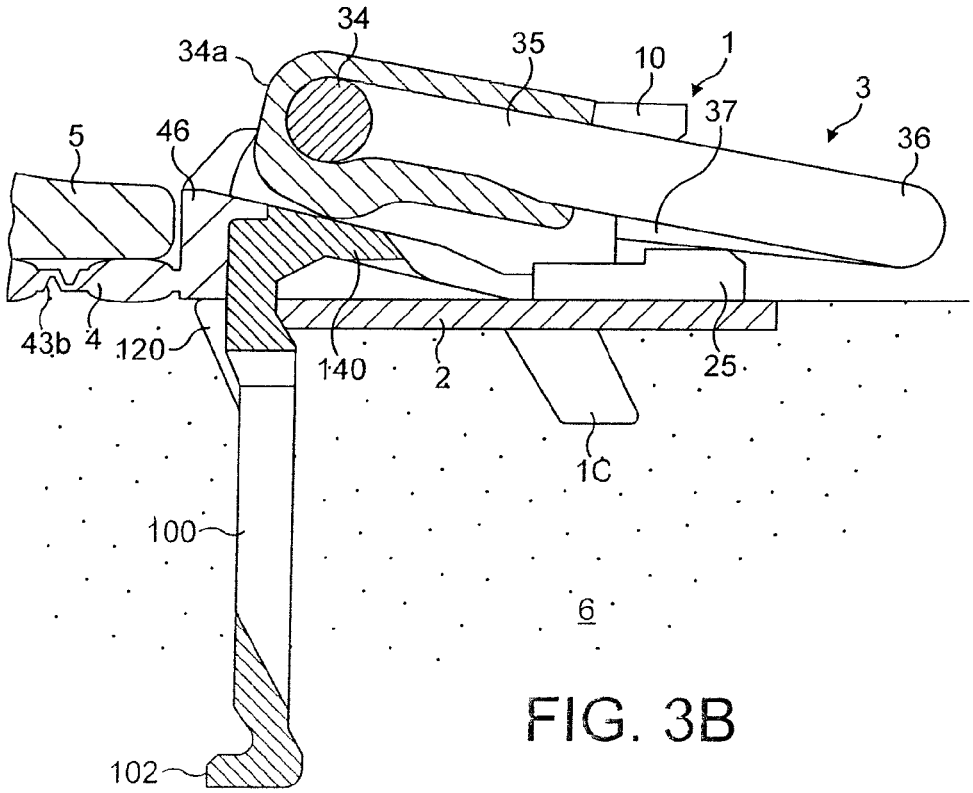
FIG. 3B illustrates a railway rail fastening assembly employing a sealing plate in a part cross-sectional view in which a rail fastening clip is in a pre-assembly position with respect to the rail.
Figure 3C:
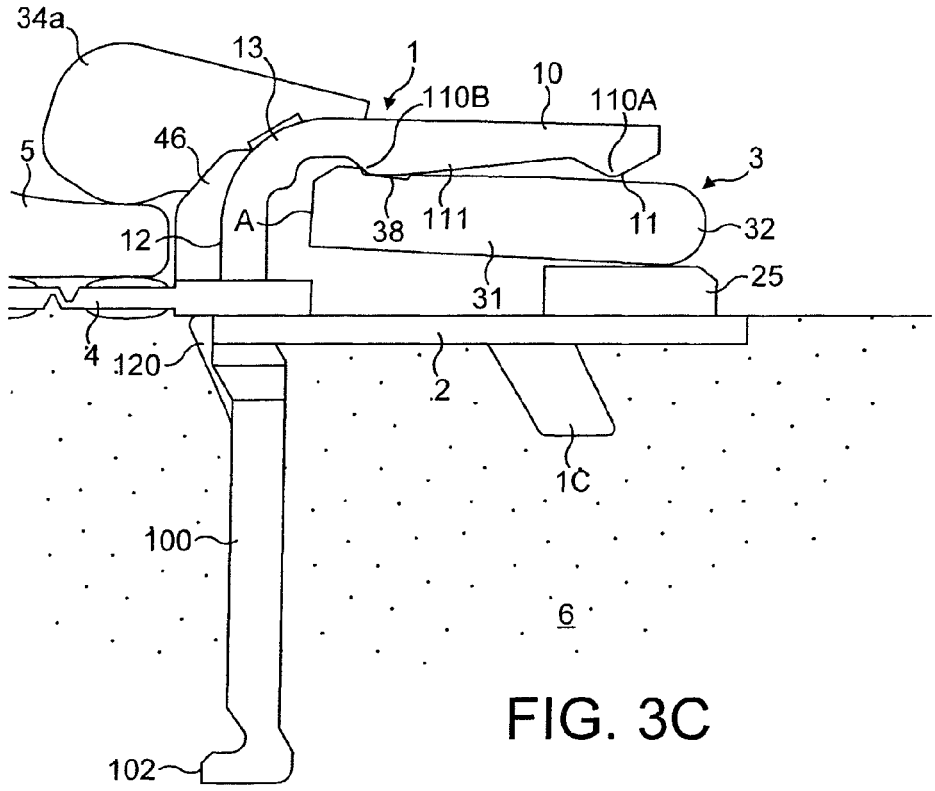
FIG. 3C illustrates a railway rail fastening assembly employing a sealing plate in another side view in which a rail fastening clip is bearing on the rail.
Figure 3D:
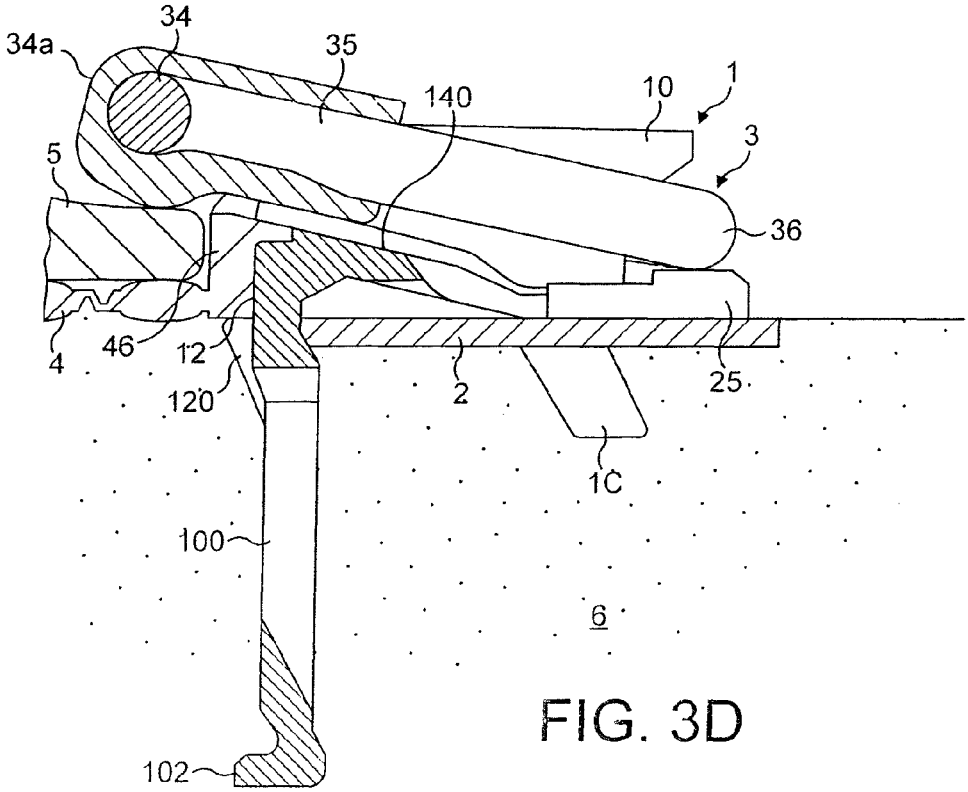
FIG. 3D illustrates a railway rail fastening assembly employing a sealing plate in a part cross-sectional view in which a rail fastening clip is bearing on the rail.
Figure 3E:
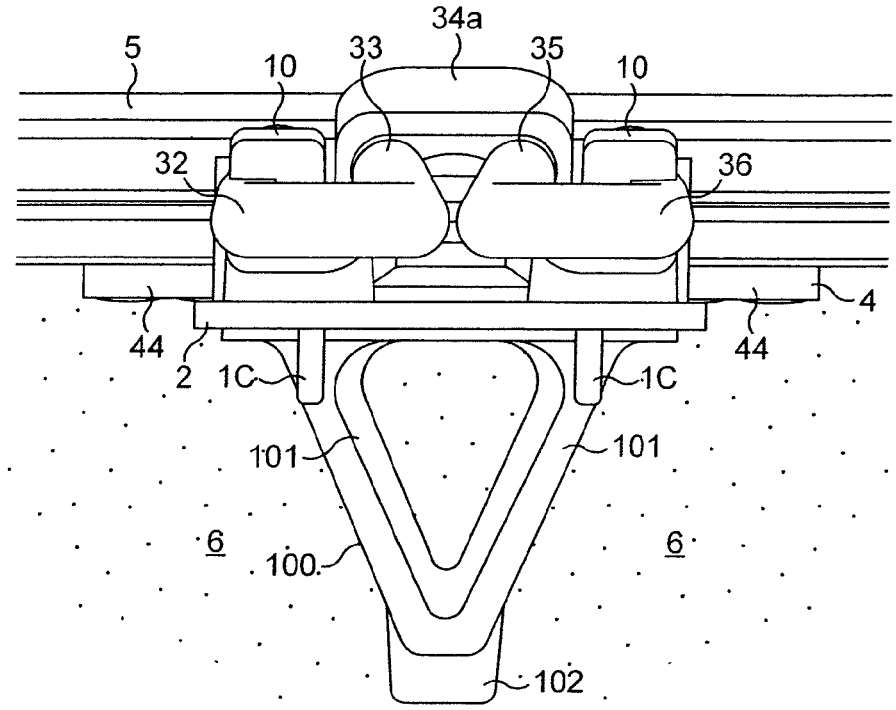
FIG. 3E illustrates a rear view of the railway rail fastening assembly employing a sealing plate.
Figure 3F:
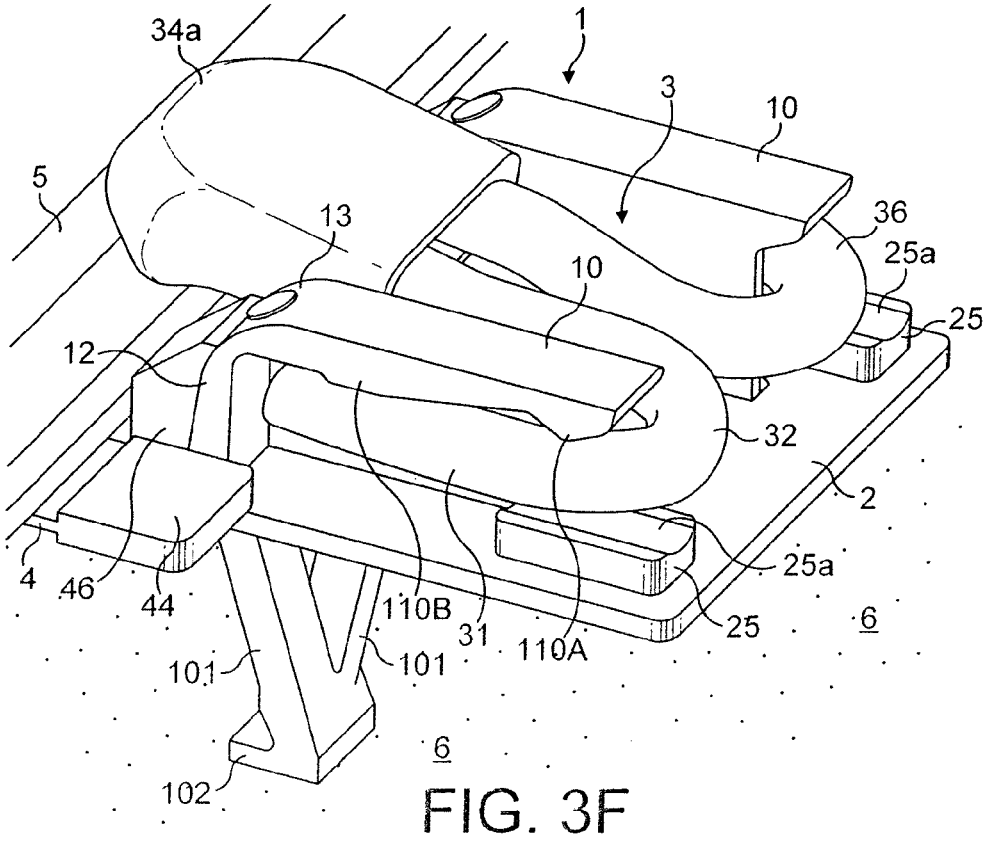
FIG. 3F illustrates a perspective view of the railway rail fastening assembly employing a sealing plate.

Reference will now be made, by way of example, to the accompanying drawings in which:

FIG. 1 shows a sealing plate embodying the first aspect of the present invention, FIG. 1A showing a perspective view from above, FIG. 1B showing a plan view of the top surface of the sealing plate, FIG. 1C showing a plan view of the underside of the sealing plate, FIG. 1D showing a sectional view taken along the line Y-Y in FIG. 1B, FIG. 1E showing a front view of the sealing plate and FIG. 1F showing a cross-sectional view taken along the line Z-Z in FIG. 1B;

FIG. 2 shows an anchoring device suitable for use wish a sealing plate embodying the first aspect of the present invention, FIG. 2A showing a perspective view from above, FIG. 2B showing a front view, FIG. 2C showing a part sectional view taken on the line Z-Z in FIG. 2B, FIG. 2D showing a rear view, FIG. 2E showing a side view, FIG. 2F showing a plan view from above, FIG. 2G showing a plan view from below and FIG. 2H showing a side view of another anchoring device suitable for use with a sealing plate embodying the first aspect of the present invention; and FIG. 3 shows a railway rail fastening assembly employing a sealing plate embodying the present invention, in which FIGS. 3A and 3B show the assembly in a side view in which a rail fastening clip is in a pre-assembly position with respect to the rail, FIG. 3B being a part cross-sectional view, FIGS. 3C and 3D show another side view of the assembly in which the clip is bearing on the rail, FIG. 3D being a part cross-sectional view, FIG. 3E shows a rear view of the assembly and FIG. 3F shows a perspective view of the assembly.

A plastic sealing plate 2 embodying the first aspect of the present invention will now be described with reference to FIGS. 1A to 1F. The sealing plate 2 has a first major face 20 which is uppermost when the plate 2 is in use on the top of a sleeper and a second major face 21 opposite to the first. The sealing plate 2 is substantially rectangular in outline, having a cut-out portion along one side 22, defining ears 23 which ensure a seal at the corners of a shoulder 1 located above the plate 2 within the cut-out 22. The cut-out 22 has a bevelled edge 22*a* which mates with a corresponding bevelled edge on the rear face 15 of the shoulder 1. The cut-out 22 also has radiussed recesses 24 for mating with corresponding radiussed portions of the shoulder 1.

The first major face 20 of the sealing plate 2 is formed with two clip seat projections 25, which are substantially L-shaped and are located in respective corners of the first major face 20 adjacent to the side of the plate which is opposite to that having the cut-out 22. The clip seat projections 25 have respective top surfaces 25*a*, which are planar in FIGS. 1A to 1F, but may have some form of profile (see FIG. 3F) to match that of the part of the clip which is to bear on the projections 25, with a view to reducing plastic flow and wear in these areas. The plate 2 may have reinforcement in the region of the clip seat projections 25, for example the projections may be formed of a stronger material or reinforced with small steel bearing plates.

With reference to FIGS. 2A to 2G an anchoring device (shoulder) suitable for use with a sealing plate embodying the first aspect of the invention will now be described. The anchoring device 1 shown in FIGS. 2A to 2G comprises a head 1A from the underside of which downwardly project a stem part 1B and two spaced-part tangs 1C. The stem part 1B comprises a substantially Y-shaped stem 100, connected to the underside of the head 1A at the ends of upper arms 101 of the Y, and a bent part 102 at the other end of the Y for resisting withdrawal of the stem from the concrete in which it is embedded when it is in use. As shown in FIG. 2H, which shows another shoulder suitable for use with a sealing plate embodying the first aspect of the present invention, the underside of the shoulder 1 may be provided with one or more webs 1D connecting the stem 100 of the shoulder 1 to its head 1A, instead or in addition to the tangs 1C (not shown in FIG. 2H), for assisting in preventing the shoulder 1 tipping forward when a clip is driven into it.

The head 1A of the anchoring device 1 comprises two spaced-part walls 10, connected together at one end of the head 1A, at the bottom of the walls 10, by a connection portion 14. The top surface of the connection portion 14 is downwardly inclined and forms a ramp 140, while the front surface of the connection portion 14 forms the front face 12 of the shoulder 1. The end of the walls 10 at the front end of the head 1A are connected to the front face 12 of the shoulder by curved portions 13.

The walls 10 extend outwardly at their tops to provide respective clip-engaging surfaces 11 provided with two clip-engaging projections 110A, 110B, which project downwardly and are connected by means of a ramped surface 111 which inclines downwardly from the rear of the shoulder 1 to the front of the shoulder 1, for deflecting the leg of a railway rail fastening clip. The front face 12 of the shoulder 1 is provided with projections 120 for engaging with the sleeper mould so as to set the shoulder at the correct height in the mould before the concrete is introduced. The shoulder 1 has a rear face 15 opposite to the front face 12.

Referring once again to FIGS. 1A to 1F, apertures 26 are formed through the major faces 20/21 of plate 2 so as to receive portions of the shoulder 1, namely the tangs 1C, which extend through the apertures 26 in the plate 2 into the concrete of the sleeper. The major face 20 of the plate 2 is also formed with upstanding tabs 27 which are provided for cooperating with respective features on the underside of the shoulder 1 to retain the plate 2 on the shoulder 1 (and vice versa) before the plate 2 and shoulder 1 have been set into the concrete of the sleeper. If the plate is to be used with a shoulder 1 as shown in FIG. 2H, in which webs 1D are provided on the underside of the shoulder 1 between the stem 100 and the head 1A, the radiussed recesses 24 on the plate 2 would have to be deeper. If the tangs 1C on the underside of the shoulder 1 were omitted, the apertures 26 in the plate 2 could be made smaller, but would still be present to allow formation of the underside of tabs 27 during moulding of the sealing plate 2.

The shoulder 1 is held in place and positioned in the mould by means of a mechanism which pulls on the head 1A that protrudes through the bottom of the mould. The projections 120 on the shoulder 1 serve to reduce the amount of this pulling force which is applied to the sealing plate, which might otherwise distort. The walls of the projections 25 serve to prevent sideways movement of the sealing plate and shoulder during sleeper manufacture by acting against the edges of the aperture in the mould pocket.

The second major face 21 of the plate 2, which forms the underside of the plate, is formed with a plurality of intersecting ribs 28 which define numerous rebates 29. When the plate is set into the top surface of a concrete sleeper, these rebates 29, and the underside of the projections 25 which are also hollow, are filled with concrete, providing additional strength to the plate 2, and thereby reducing the amount of material, and hence cost, required to make the plate 2.

A railway rail fastening assembly employing the elements described above will now be described with reference to FIGS. 3A to 3F. The railway rail fastening assembly of FIGS. 3A to 3F, for fastening a railway rail 5, comprises a shoulder 1 as described with reference to FIGS. 2A to 2G, a rail fastening clip 3, a sealing plate 2 embodying the first aspect of the present invention and a rail pad 4. It will be appreciated that, although not shown in FIGS. 3A to 3F, when in use the rail is fastened on both sides of the rail head by such an assembly and that the stem 1B and tangs 1C are embedded in the concrete sleeper 6. The sealing plate 2 is also embedded in the concrete sleeper 6, such that the top face of sealing plate 2 is flush with the upper surface of the sleeper 6. As shown in FIGS. 3A/3B the clip 3 may be driven into the shoulder 1 by introducing the chamfered free ends A, B of clip legs 31, 37 into the gaps between the top surfaces 25*a* of the clip seat projections 25 on the sealing plate 2 and the first projection 110A on the outer surface of the walls 10 of the shoulder 1, and inserting toe portion 34 of the clip 3, bearing a toe insulator 34*a*, into the space between the inner surfaces of the walls 10 of the shoulder 1, such that the toe 34 of the clip 3, through the toe insulator 34*a*, bears on the ramp 140 of the shoulder 1 and the projections 110A are located within detents 38 in the clip legs 31, 37, with the projection 110A contacting the rear face of the detent 38. This position is known as the "pre-assembly" or "parked" position, in which the clip does not bear on the rail 5, but overlies shelf 47 of side post insulator portion 46 of pad 4. Downwardly-facing parts of the legs 31, 37 rest on the top surfaces 25*a* of the clip seat projections 25.

As shown in FIGS. 3C and 3D, the clip 3 can be driven from the pre-assembly position (first operative position) into a second operative position in which the toe portion 34 of the clip 3 bears on the foot of the rail 5, the second projections 110B on the walls 10 engage the detents 38 of legs 31, 37 of the clip 3 and second and sixth portions 32, 36 (heel portions) of the clip 3 bear on the top surfaces 25*a* of the clip seat projections 25. The clip overlies the shelf 47 of the side post insulator portion 46 of the rail pad 4. The clip can be withdrawn from this position back into the pre-assembly position, if required in order to remove or work on the rail, or further back into the "insulator-change" position in which the front face of the detent 38 contacts the projection 110A and the clip 3 does not overlie the shelf 47 of the sidepost insulator portion 46 of pad 4.

As the clip 3 is installed, the toe 34 of the clip 3 is driven upwards by the ramp 140 in the centre of the shoulder 1, and the legs 31, 37 are driven down, thereby splitting the clip open. This makes it possible to make the assembly a little lower than would otherwise be possible.

The invention claimed is:

1. A method of manufacturing a concrete sleeper with at least one embedded rail clip anchoring device of the type having a head for retaining a rail clip and a stem extending from the underside of the head, in which method the floor of a mould, from which the sleeper is to be formed, is provided with an aperture, the head of an anchoring device is inserted through the aperture such that the head of the device extends out of the mould and the stem of the device is located within the mould, and concrete is introduced into the mould, characterised in that before the concrete is introduced into the mould the aperture is sealed off around its edges and around the underside of the head of the anchoring device by placing a sealing plate over the aperture on the floor of the mould, the plate overlapping and sealing around the edges of the aperture other than where the anchoring device is located and having a mating interface with the anchoring device such that a seal is formed therewith.

2. The method as claimed in claim 1, wherein before the sealing plate is introduced into the mould it is connected to the anchoring device so as to extend over the underside of the head, the sealing plate being introduced into the mould together with the anchoring device and located over the aperture when the head is inserted through the aperture.

3. The method as claimed in claim 1, wherein, when the aperture is substantially rectangular and a first face of the head of the anchoring device abuts one side of the aperture, the sealing plate is shaped so as to mate with a second face of the head of the anchoring device, opposite to said first face, and to overlap the edges of the aperture on the other three sides thereof.

4. The method as claimed in claim 3, wherein the edge of the sealing plate which mates with the second face of the head is bevelled so as to match bevelling on the said second face.

5. The method as claimed in claim 1 which includes providing at least one sealing plate and an anchoring device having a head and a stem which extends from the head into a concrete sleeper when the anchoring device is in use, the plate is adapted for extending over the underside of the head when the stem of the device is being set in a concrete sleeper, thereby to prevent ingress of concrete into the head of the device, and for being retained on the surface of the sleeper thereafter, wherein a major face of the plate, which is uppermost when the sleeper is in use, is provided with at least one clip seat portion for receiving part of a rail clip or, a sealing plate and anchoring device combination, the anchoring device having a head and a stem which extends from the head into a concrete sleeper when the anchoring device is in use, the plate is adapted for extending over the underside of the head when the stem of the device is being set in a concrete sleeper, thereby to prevent ingress of concrete into the head of the device, and for being retained on the surface of the sleeper thereafter, wherein a major face of the plate, which is uppermost when the sleeper is in use, is provided with at least one clip seat portion for receiving part of a rail clip, and the anchoring device of the combination having two interconnected spaced-apart walls, between which a portion of the clip to be retained is held when the anchoring device is in use, and clip-engaging means, supported by the walls, for engaging a portion of the rail fastening clip to be retained, wherein the device does not have any feature or surface which engages the surface of that clip portion which faces downwardly when the clip is in use.

* * * * *